United States Patent [19]

Auchter et al.

[11] 4,174,791

[45] Nov. 20, 1979

[54] LIQUID-GAS PUMPING APPARATUS

[75] Inventors: Bruno Auchter, Mainz; Karl-Heinz Wagner, Rauenthal; Günter Glimm; Manfred Preiss, both of Erlangen, all of Fed. Rep. of Germany

[73] Assignees: Rheinhütte vorm. Ludwig Beck & Co., Wiesbaden-Biebrich; Siemens Aktiengesellschaft, Munich, both of Fed. Rep. of Germany

[21] Appl. No.: 876,690

[22] Filed: Feb. 10, 1978

[30] Foreign Application Priority Data

Feb. 18, 1977 [DE] Fed. Rep. of Germany ..... 2707042

[51] Int. Cl.[2] ..... B67D 5/04; F04B 35/04

[52] U.S. Cl. ..... 222/333; 222/385; 417/360

[58] Field of Search ..... 222/333, 383, 385, 376; 417/360, 422

[56] References Cited

U.S. PATENT DOCUMENTS

| | | | |
|---|---|---|---|
| 3,112,049 | 11/1963 | Messer | 222/385 X |
| 3,369,715 | 2/1968 | Carter | 222/333 |
| 3,876,120 | 4/1975 | Haesloop et al. | 222/333 |
| 3,963,381 | 6/1976 | Kohnen | 417/360 |

*Primary Examiner*—Robert J. Spar
*Assistant Examiner*—Edward M. Wacyra
*Attorney, Agent, or Firm*—Kenyon & Kenyon

[57] ABSTRACT

A liquid-gas pumping apparatus includes an immersion pump and motor unit vertically slidable within a housing extending into a cryogenic liquid storage tank, a plurality of valves opened by engagement with the pump and motor unit are circumferentially spaced adjacent the bottom of the housing with one of the valves adapted to be opened before the other valves and permanent electrical supply contacts extending through the housing to be engaged by contacts on the pump and motor unit.

5 Claims, 4 Drawing Figures

LIQUID-GAS PUMPING APPARATUS

BACKGROUND OF THE INVENTION

1. Field of the Invention

The present invention relates generally to a liquid-gas pumping apparatus for pumping cryogenic liquids from a storage tank, which apparatus includes a vertical housing extending into the tank which functions as a pumping line, an immersion pump and motor unit which is slidably insertable into the housing, and valve means disposed at the lower end of the housing which opens when the immmersion pump and motor are lowered into the housing and closes when the pump and motor are raised in the housing.

2. Description of the Prior Art

Immersion pump and motor units in which the pump impeller and the rotor of an electric motor are mounted on a single shaft are known in the art and are generally used for pumping liquids. Such immersion pump and motor units are installed at the vertically lowest point of a tank or well so that the tank or well can be emptied to as great an extent as possible. It is also known in the art to use such pumps to empty liquid-gas tanks. In such applications, however, it must be possible to empty the tank in the event the pump fails. This can be accomplished, for example, by forcing the liquid out of the tank. There are limits to what can be achieved by this method, however, since liquid-gas tanks cannot be subjected to arbitrarily high stress pressures, and utilization of this method is not without danger.

In one such apparatus described in U.S. Pat. No. 3,369,715, a movable immersion pump and motor unit is introduced into a liquid-gas tank through a lock and well-like housing which extends downwardly to the bottom of the tank. The pump and motor unit is lowered to the bottom of the tank to empty the tank, and the electrical connection to the immersion pump and motor unit is effected by means of electrical cables which are lowered into the tank with the immersion pump and motor unit. A single foot-valve is located at the bottom of the liquid-gas tank which is engaged by the movable immersion pump and motor unit and opens toward the bottom of the tank. In this design, the foot valve is opened by the weight of the pump and motor unit only if the force required to open the foot valve is less than the weight of the pump and motor unit.

The opening force produced by the level to which the tank is filled with fluid and the density of the fluid to be pumped are usually greater than the weight of the pump and motor unit so that it is necessary to use a linkage with a spindle to assist with the operation of the foot valve. This linkage extends through the top of the tank to either the foot valve on the bottom of the tank or to the pump and motor unit. In order to prevent buckling, the linkage is guided through supports at the linkage or in the housing. In large tanks, the linkage is subdivided because of the great height of the tank and comprises subsections during lowering. As a result, the immersion pump and motor unit can be only lowered incrementally which causes a corresponding loss of time. The vapors and gases escaping from the tank during assembly of the linkage must also be drawn off to prevent the formation of a dangerous situation. A stuffing gland seal is used to seal the linkage to the tank top in a pressure-proof manner at the point where the linkage extends through the tank top. A hand wheel for operating the linkage is provided to permit axial movement of the linkage by means of a threaded spindle.

The parts of the immersion pump and motor unit which are subjected to the most danger are the electric supply lines and the stuffing gland seals for the operating linkage of the foot valve. The insulation of the electrical supply cables easily becomes brittle, and therefore useless, particularly when the pump and motor unit is removed from a tank filled with liquid gas or from a tank from which the liquid gas has been discharged and in the interior of which a temperature of about 100 K can prevail. A similar weakness is the stuffing gland seal since it is likewise exposed to the low temperature of the liquid gas.

SUMMARY OF THE INVENTION

It is therefore an object of the present invention to provide an improved liquid-gas pumping apparatus which overcomes the aforementioned disadvantages of heretofore known apparatus and in which movable electrical supply cables and linkages for operating the foot valve of the apparatus which extend through the top of the tank can be eliminated.

It is also an object of the present invention to provide an improved liquid-gas pumping apparatus in which operation of the valves is achieved solely by the weight of the immersion pump and motor unit independently of the level to which the tank is filled, the density of the fluid to be pumped, and the internal pressure in the tank.

These and other objects of the invention are achieved in a liquid-gas pumping apparatus for pumping cryogenic liquids from a storage tank, which apparatus includes a vertical housing extending into the tank which functions as a pumping line, an immersion pump and motor unit which is slidably insertable into the housing, and valve means disposed at the lower end of the housing which opens when the immersion pump and motor unit is lowered into the housing and closes when the pump and motor unit is raised in the housing. The improvement comprises means, disposed at the vertically upper end of the housing, for lowering the immersion pump and motor unit into an operating position in the housing and for lifting the immersion pump and motor unit from the operating position. A plurality of valve means are disposed adjacent the bottom of the housing and open laterally through the housing. The valve means are uniformly distributed over the circumference of the housing and at least one of the valve means is disposed in the housing and adapted so as to be engaged first by the immersion pump and motor unit before the other of the valve means when the pump and motor unit is lowered in the housing into the operating position. The one of the valve means is thereby opened first before the other of the valve means upon engagement with the immersion pump and motor unit. Electrical supply line means extends from the exterior of the housing through the housing into the interior thereof, and first electrical contact means is disposed in the interior of the housing and is coupled to the electrical supply line means. Second electrical contact means is mounted on the immersion pump and motor unit and is adapted to engage the first electrical contact means and establish an electrical connection between the immersion pump and motor unit and the electrical supply line means when the immersion pump and motor unit is lowered into the operating position in the housing.

The apparatus of the invention enables the movable immersion pump and motor unit to be electrically connected to permanent, built-in, electrical supply lines, for example, by relatively insensitive mineral-insulated leads. Thus, in the apparatus of the invention, the immersion pump and motor unit can be automatically electrically coupled and decoupled to the supply lines during lowering of the pump and motor unit into the liquid-gas tank and during withdrawal of the pump and motor unit from the tank. In addition, in contrast to prior art arrangements including only one lateral valve, uniform, cavitation-free flow to the pump impeller is not adversely affected by the uniform distribution of the plurality of lateral valves. Pressure-independent opening of the valves by means of the weight of the immersion pump and motor unit is also achieved. As a result, the lateral valves for the immersion pump can be opened without utilizing an actuating spindle and the heretofore customary stuffing gland seal can be eliminated. Leaks from the tank are thereby avoided and the operating safety of the overall installation is increased.

These and other novel features and advantages of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1A:
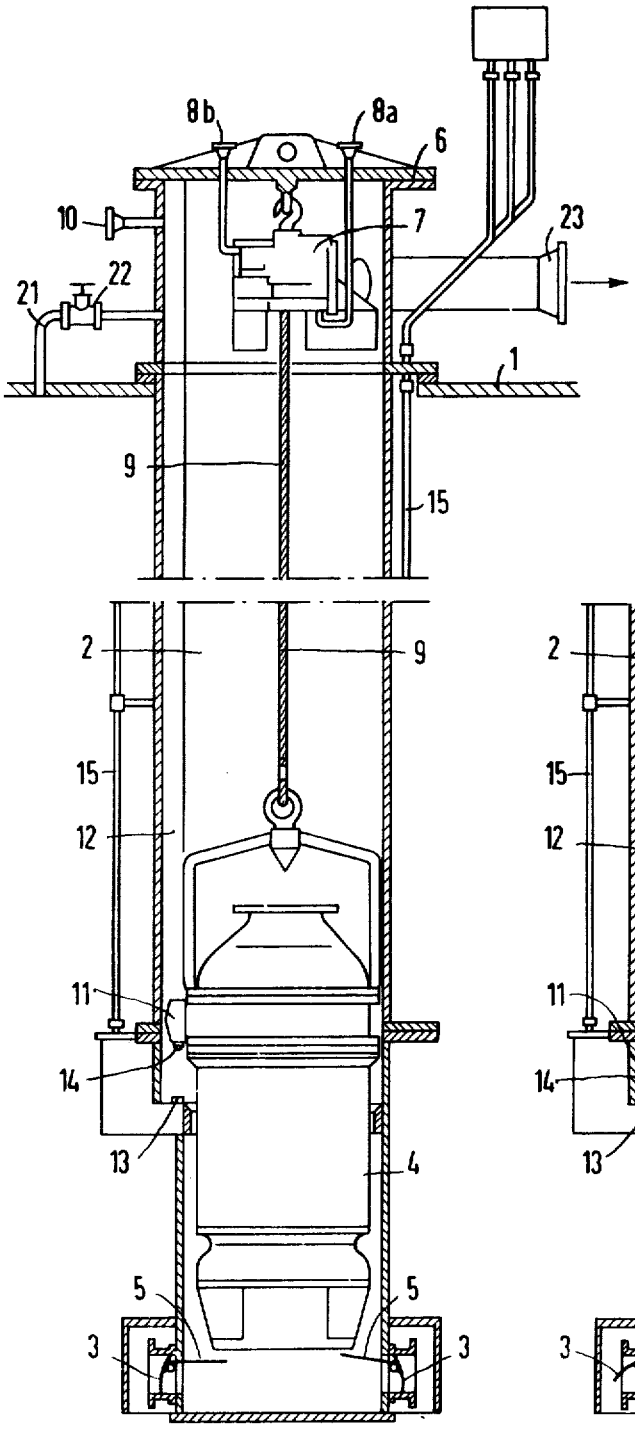
FIG. 1*a* is a partial, cross-sectional view of an improved liquid-gas pumping apparatus constructed according to the present invention showing the immersion pump and motor unit in the liquid-gas tank before it reaches its operating position in the tank.

Referring now to the drawings, and in particular to FIG. 1*a*, there is shown a well-like, vertical housing 2 which is disposed in a storage tank 1 for liquid gas. The housing has an outlet located in its upper part including a pressure line 23 and a plurality of lateral valves 3 which are uniformly distributed over the circumference of the housing adjacent the bottom of the housing. Before pumping of liquid gas from the tank begins, the housing is first closed at the top by a dummy cover (not shown). Nitrogen is passed through a pipeline 10 into the housing, which is tightly flanged. This pushes the liquid gas into the tank through lateral valves 3 which open. After the liquid gas is expelled from housing 2, the nitrogen pressure in the housing is reduced, so that the lateral valves 3 close and the liquid gas is prevented from flowing back into the housing. The dummy cover at the upper end of the housing is then removed and the immersion pump and motor unit 4 is slidably inserted into the housing and lowered therein. Shortly before actuating levers 5 provided on the lateral valves 3 are reached by the pump and motor unit, a cover 6 is bolted to the flange of the housing 2. A lifting and lowering device 7 holds the immersion pump and motor unit 4 in the desired position in the housing above actuating levers 5 for the valves. This lifting and lowering device 7 is mounted inside the housing at its vertically upper end on the cover 6 thereof and preferably comprises a nitrogen-operated hoisting device. A nitrogen feed line 8*a* extends through cover 6 to the hoisting device. A nitrogen discharge 8*b* line also extends through cover 6 to the device.

Figure 1B:
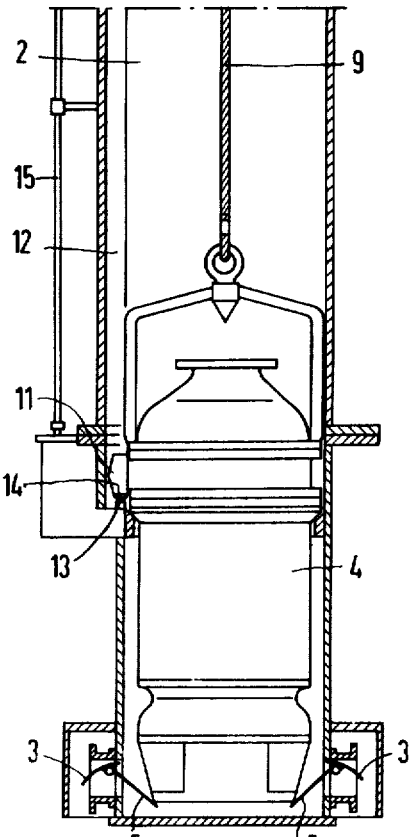
FIG. 1*b* is a partial, cross-sectional view of the pumping apparatus of the invention showing the immersion pump and motor unit in its operating position in the tank.

Admitting nitrogen to the nitrogen feed line 8*a* causes the immersion pump and motor unit 4, which is suspended from a cable 9 (or a chain), to move downwardly in the housing toward its operating position (see FIG. 1*b*). The immersion pump and motor unit 4 then first pushes open, through the force of its own weight, one of the lateral valves 3 (in the illustrated embodiment of the invention, the one to the right) by means of actuating lever 5 (the actuating lever of this valve is inclined upwardly at an angle which is greater than the inclination of the other valve actuating levers so that the end of the lever is engaged first by the pump and motor unit). Thereupon, liquid gas enters housing 2 and rises through the pump until the pressure is equalized with the pressure of the nitrogen in housing 2. In the process, the immersion pump and motor unit is lowered to its operating position, thereby engaging the actuating levers of the other valves and opening these valves. By connecting housing 2 to tank 1 by means of a pressure equalizing line 21 and operating a valve 22 coupled to the line, pressure equalization between tank 1 and housing 2, and, thereby, equalization of the levels between tank 1 and housing 2, is obtained.

During lowering of the immersion pump and motor unit into its operating position, the unit is guided by a pilot projection 11 disposed in a groove 12 provided in housing 2 so that electrical contacts 13 mounted on housing 2 in the interior thereof engage mating electrical contacts 14 mounted on the immersion pump and motor unit 4 and the unit is automatically electrically coupled to electrical supply lines 15 which are permanently installed in the tank 1 and are connected to contacts 13.

Figure 1C:
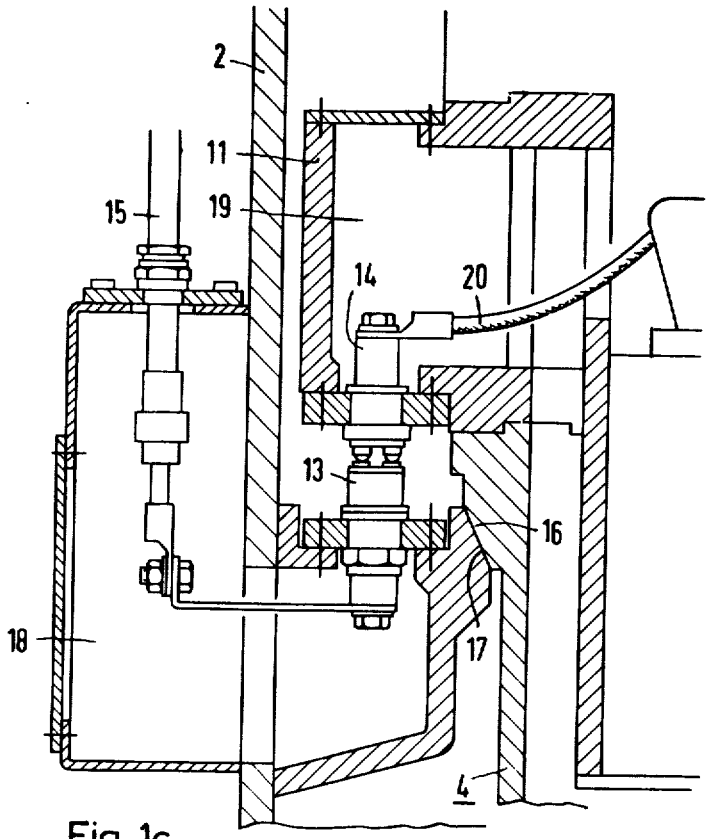
FIG. 1*c* is a partial, longitudinal cross-sectional, enlarged view of the electrical contacts of the pumping apparatus shown in FIG. *b*.
Figure 1D:
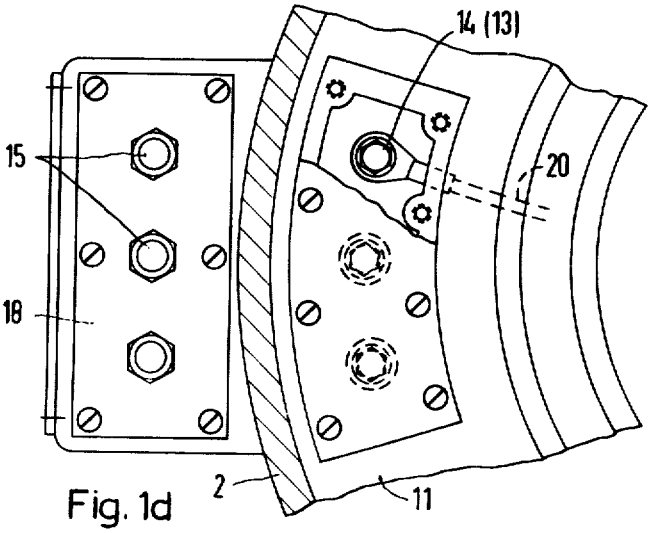
FIG. 1*d* is a partial, transverse cross-sectional view of the pumping apparatus illustrated in FIG. 1*c*.

As shown in FIGS. 1*c* and 1*d*, electrical contacts 13 are lectrically insulated from and are immovably mounted on housing 2 and are connected to electrical supply lines 15 in a junction box 18. Electrical contacts 14 mounted on the pump and motor unit 4 preferably comprise spring-loaded pressure electrical contacts. These contacts are connected in another junction box 19 to electrical lines 20 which are coupled to the electric motor of the pump. The housing of junction box 19 also functions as the guide projection 11.

The immersion pump and motor unit 4 includes a conical-shaped sealing ring 16 which engages a fixed sealing ring 17 on housing 2 when the immersion pump and motor unit 4 is lowered into its operating position in the housing. The lower suction space of the pump is thereby separated from the upper pressure space of the pump in the housing. When sealing rings 16 and 17 contact each other, the immersion pump and motor unit can be put into operation.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a liquid-gas pumping apparatus for pumping cryogenic liquids from a storage tank, said apparatus including a vertical housing extending into said tank which functions as a pumping line, an immersion pump and motor unit which is slidably insertable into said housing, and valve means disposed at the lower end of said housing which opens when said immersion pump and motor unit is lowered into said housing and closes when said pump and motor unit is raised in said housing, the improvement comprising means, disposed at the vertically upper end of said housing, for lowering said immersion pump and motor unit into an operating position in said housing and for lifting said immersion pump and motor unit from said operating position;

a plurality of said valve means, disposed adjacent the bottom of said housing and opening laterally through said housing, said valve means being uniformly distributed over the circumference of said housing, at least one of said valve means being disposed in said housing and adapted so as to be engaged first by said immersion pump and motor unit before the other of said valve means when said pump and motor unit is lowered in said housing into said operating position, said one of said valve means thereby being opened first before the other of said valve means upon engagement with said immersion pump and motor unit;

electrical supply line means extending from the exterior of said housing through said housing into the interior thereof;

first electrical contact means disposed in said interior of said housing and coupled to said electrical supply line means; and second electrical contact means mounted on said immersion pump and motor unit and adapted to engage said first electrical contact means and establish an electrical connection between said immersion pump and motor unit and said electrical supply line means when said immersion pump and motor unit is lowered into said operating position in said housing.

2. The pumping apparatus recited in claim 1, wherein said first electrical contact means comprises fixed electrical contacts mounted on said housing in the interior thereof and said second electrical contact means comprises spring-loaded pressure electrical contacts mounted on said immersion pump and motor unit.

3. The pumping apparatus recited in claim 1, wherein said second electrical contact means is mounted on said immersion pump and motor unit so as to be forced into engagement with said first electrical contact means by the weight of said pump and motor unit.

4. The pumping apparatus recited in claim 1, wherein said housing includes cover means and said lifting and lowering means is mounted in the interior of said housing at the vertically upper end thereof on said cover means.

5. The apparatus recited in claim 1, wherein said lifting and lowering means comprises nitrogen gas-operated hoisting means.

* * * * *